US006327750B1

(12) United States Patent
Muldowney et al.

(10) Patent No.: US 6,327,750 B1
(45) Date of Patent: Dec. 11, 2001

(54) FINAL TENSIONING DEVICE FOR LACED CLOSURE

(75) Inventors: Loren S. Muldowney, Highland Park, NJ (US); Donald W. Scott, Colden, NY (US)

(73) Assignee: Don Scott Associates, Inc., Colden, NY (US)

( * ) Notice: Subject to any disclaimer, the term of this patent is extended or adjusted under 35 U.S.C. 154(b) by 0 days.

(21) Appl. No.: 09/519,941

(22) Filed: Mar. 7, 2000

(51) Int. Cl.[7] ..... A43B 11/00; A43C 7/08

(52) U.S. Cl. ..... 24/68 SK; 24/70 SK; 24/712.1; 24/712.2

(58) Field of Search ..... 24/68 SK, 70 SK, 24/71 SK, 69 SK, 712.1, 713.5, 712.2; 36/50.1

(56) References Cited

U.S. PATENT DOCUMENTS

| | | | | |
|---|---|---|---|---|
| 3,262,167 | * | 7/1966 | Martin | 24/68 SK |
| 3,296,667 | * | 1/1967 | Streule | 24/68 SK |
| 4,081,916 | | 4/1978 | Salisbury | 36/50 |
| 4,157,622 | * | 6/1979 | Carlyle | 36/50.1 |
| 4,253,217 | | 3/1981 | Marzocchi | 24/69 SK |
| 4,395,801 | | 8/1983 | Gabrielli | 24/70 SK |
| 5,129,130 | | 7/1992 | Lecouturier | 24/712 |
| 5,353,483 | | 10/1994 | Louviere | 24/712.1 |
| 5,469,640 | | 11/1995 | Nichols | 36/50.1 |
| 5,572,777 | | 11/1996 | Shelton | 24/712 |
| 5,613,283 | | 3/1997 | Yusfan | 24/713 |
| 5,718,021 | | 2/1998 | Tatum | 24/712.2 |
| 5,934,599 | | 8/1999 | Hammerslag | 242/396.1 |
| 6,029,323 | * | 2/2000 | Dickie et al. | 24/712.1 |

* cited by examiner

*Primary Examiner*—Victor N. Sakran

(57) ABSTRACT

A lace-tensioning device which is a rigid cylindrical body (64) with two passages (58, 60) aligned parallel to the cylindrical axis and a handle element (62) projecting from the body (64) perpendicular to the cylindrical axis and functioning as a lever. The device is used in a laced closure by modifying the lacing pattern from the standard alternating pattern at one of the pairs of guide elements (68, 70) of the closure and threading the lace (75) through both passages (58, 60) of the tensioning device. A segment of lace (76) from one side (82) of the closure goes through one passage (60) in the device and then back to the same side (82) of the closure from which it came. A segment of lace (78) from the opposing side (84) of the closure goes through the other passage (58) in the tensioning device and back to the same opposing side (84) from which it came. The lace (75) is otherwise laced conventionally and its ends are tied together in a secure knot. The device is used by rotating the handle element (62) about the cylindrical axis until it is stopped by contact with the material on the opposite side (84) of the closure. The user gains mechanical advantage in applying tensioning force to the lace (75) whereby the sides (82, 84) of the closure are pulled together with more force than the same user would otherwise be able to generate.

7 Claims, 6 Drawing Sheets

Fig. 5A
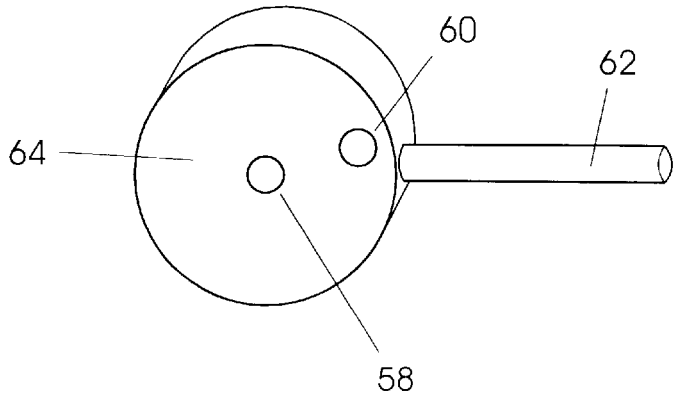
Fig. 5B
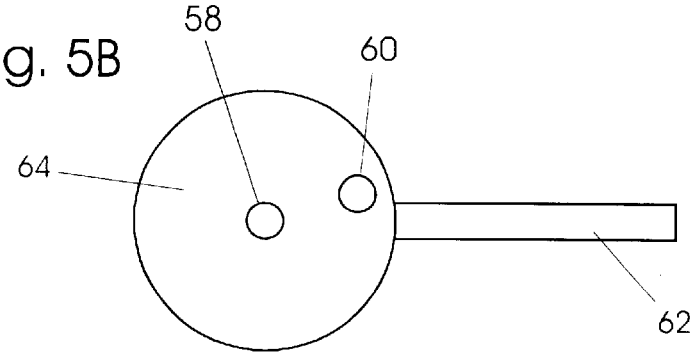
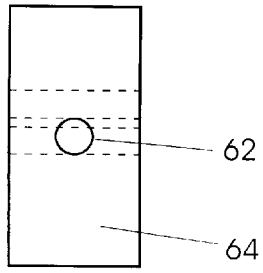
Fig. 5D
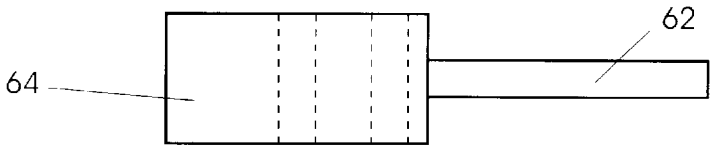
Fig. 5C

FINAL TENSIONING DEVICE FOR LACED CLOSURE

BACKGROUND—FIELD OF THE INVENTION

This invention relates generally to closure systems which employ cords or laces, and more particularly to a tensioning device to be used in the closure system of an article of footwear secured by a shoe lace.

BACKGROUND—GENERAL

Throughout this specification and the appended claims, the word "shoe" is used to refer to any exterior footwear, be it boot, shoe, sneaker, or any athletic shoe, skate, or cleat.

Laced shoes have been in widespread use for hundreds of years. The conventional shoe lace is a smooth, strong, flexible, elongated member made of cloth, leather, or plastic.

A typical laced shoe is made up of two general parts, an upper and a sole. The sole, normally of a more durable and stiff material than the upper, contacts the ground and is fastened to the upper. The upper is designed to enclose the foot snugly and comfortably, with an opening or throat through which the wearer inserts and retracts the foot. In principle, all shoe closure systems serve to secure the upper against the foot.

Guide elements disposed in series along the lateral and medial edges of the throat opening receive and guide the shoe lace, anchoring the shoe lace to the upper while allowing the shoe lace to slide freely along its length. Such a guide element may be a simple through-hole, a friction-reducing eyelet, a hook, or any other element which serves the same function. The shoe lace is threaded through the guide elements and back and forth across the opening such that it straddles the throat in a crisscross pattern. After the foot is inserted into the shoe, the two ends of the shoe lace are pulled to bring together the edges of the throat opening, thereby tightening the upper around the foot. Then the two ends of the shoe lace are tied together to prevent the inadvertent loosening of the shoe.

One of the difficult and time-consuming activities of athletes who wear skates or other lace-up footwear is adjusting the lace tension so that the footwear is securely fastened to the foot. For the best athletic performance, the footwear must be laced so that it does not allow the foot to move within the boot or shoe.

The tight fit beneficial to athletic performance is a disadvantage to an athlete at rest. During periods of relative inactivity, to promote circulation and to prevent cramping, the athlete may untie and unlace the boot or shoe, which requires that he or she then go through the entire procedure of securing the shoe again before resuming vigorous activity.

The problem, known to anyone who has attempted to secure ice skates, is that one hand is required to grip each of the two ends of the lace and pull it tight. The hands must then be repositioned to grip the two ends of the lace beyond the next pair of eyelets. If the shoe is not completely laced, the hands must thread the lace through the next eyelets before pulling those lace segments tight. Finally, the hands must again reposition in order to tie together the two ends of the lace at the proximal end of the throat. During the times of repositioning, the tension in the lace relaxes so that the completely laced and tied shoe does not fit as securely as it would if the periodic repositioning and relaxing had not taken place. Adding to the difficulty is that the fitting of the athletic footwear must be accomplished while the user is in a relatively awkward position, often encumbered by the equipment donned prior to the footwear.

BACKGROUND—PRIOR ART

There have been several devices and designs intended to address or partially solve the above problems. One of the best and simplest solutions is the lace hook, a tool with a hook which projects from a handle that fits a closed or clenched hand. The hook projects between the two middle fingers and is used after a shoe or boot is laced to pull the laces tighter than they could be pulled by merely holding the lace in the fingers or hand.

Another device is described in U.S. Pat. No. 5,469,640 to Nichols (1995). With this device, the lace is threaded through a cinch plate which is adjustably fastened to the side of the shoe. After tying the lace, the cinch plate may be adjusted sideways and downward to take up any slack in the lace. This appears to be a simple and workable device for shoes which must only be snug and where preventing movement of the foot relative to the shoe is not critical.

There are several devices for securing a previously tied shoe where the user does not untie the lace to insert or withdraw the foot, but only loosens the tied lace. All such devices contemplate elimination of the tying procedure. Their common purpose is to simplify the securing procedure at the time the foot is inserted into or retracted from the shoe, while still using a shoe lace. All of these devices are based on the assumption that every time the shoe or boot is put on, the length below the knot of the properly tightened lace will be the same.

U.S. Pat. No. 5,353,483 to Louviere (1994) describes such a device which is composed of two pieces, each with three eyelet holes at the same spacing as the eyelet holes at the throat of the shoe. These two pieces are fastened to opposing sides of the throat opening by the lace, which is threaded through both the attached pieces and the shoe eyelets. The lace is tied in a preferred tightness preferably at the distal end of the throat. To secure the shoe, the two pieces are hingeably connected together by the wearer, and the free piece is rotated to a parallel position with the other piece and captured by a fastening element which is not part of the invention.

U.S. Pat. No. 3,200,458 to Marzocchi (1965) describes a fastening device which must be made a part of the shoe rather than being attached as an after-market item. In this device one row of eyelets is a separate piece from the rest of the shoe. It is connected to the shoe by two "crank levers" which rotate to open the shoe and rotate back to a secured over-center position to close the shoe. The laces, if necessary at all, remain tied in a preferred degree of tightness. Except for the fact that it must be part of the shoe design, it appears to accomplish its purpose simply and effectively.

Still another device for opening and closing a previously tied shoe is described in U.S. Pat. No. 5,572,777 to Shelton (1996). In this invention, which can be added to almost any shoe, the lace is threaded through parallel tunnels in the flat body of the device. One such tunnel is positioned near the proximal end of the throat opening and another is several eyelets away toward the distal end of the throat. The lace is loosely secured and the ends are tied together. The shoe may be slipped on or removed at this stage. The flat body of the device is then reversed end for end so that the tunnels have changed position. The lace now must travel a longer path; in so doing the slack in the lace is effectively reduced. The operation of this device tends to pull together the distal and proximal ends of the throat, but this may not cause any problems when the goal is simply to reduce the slack in the lace. This device does not have an over-center securing feature, but one of the tunnels has an oval cross section so that when it is reversed, the lace moves to the other side of the oval, which inhibits the rotation of the device back to its original position.

Making the shoe easier to secure, specifically, for children, elderly, or handicapped people is the common purpose of these last three devices described. There is no intention nor any claim of tensioning the laces tighter than would be possible without each device. All three suggest tying the lace and leaving it tied, using the device only to loosen or tighten the fit of the shoe. All three suggest tying the lace ends at the distal rather than the proximal end of the throat, a position which makes tying the lace ends together more convenient for an assistant, not for the wearer of the shoe.

Nothing in the prior art suggests a final tensioning of a shoe lace to a value which prevents relative movement between the wearer's foot and the boot or shoe.

Nothing in the prior art suggests the use of a device which provides the user with a mechanical advantage to get the lace tighter than possible without a device.

Nothing in the prior art takes into account the facts that laces stretch from one wearing to the next, that different socks make the shoe fit differently, or that feet swell from wearing to wearing and day to day, such that leaving the lace tied from one wearing to the next will result in a fit poorly suited to athletic performance. The prior art rather embodies the assumption that adjusting the length of the lace below the knot at every wearing is unnecessary for its purpose.

OBJECTS AND ADVANTAGES OF THE PRESENT INVENTION

Accordingly, several objects and advantages of the present invention are to provide and use a tensioning device which:

- can be used with or added to any existing lace-up shoe, boot, or other laced closure,
- allows the user to secure the shoe tighter than would be possible without a device,
- can be loosened without untying and swiftly retightened,
- locks in place after tensioning and cannot be easily or accidentally unlocked,
- is lightweight, very small, simple and inexpensive to manufacture,
- is easy to use,
- provides to the user mechanical advantage in applying the tensioning force, making possible a very snug fit,
- allows the user to apply tensioning force in the direction which pulls together the medial and lateral sides of the closure,
- provides non-bearing surfaces upon which to place custom logos or decorative designs, and
- can be made in one piece, providing durability and ease of manufacturing.

BRIEF DESCRIPTION OF DRAWING FIGURES

General Organization of Drawing Figures

In the drawings, closely related figures are identified by the same number with different alphabetic suffixes. FIGS. 5A–5D, 6A, 6B, 7A, 7B and 8A–8F relate to the main embodiment of the present invention. FIGS. 1A–1D, 2, and 9 illustrate an alternative embodiment of the present invention.

Specific Drawing Figures

FIG. 5A shows a perspective view of the main embodiment of the present invention.

FIG. 5B is a front elevation view of the device in FIG. 5A.

FIG. 5C is the plan view of the device in FIG. 5A.

FIG. 5D is the right side view of the device in FIG. 5A.

LIST OF REFERENCE NUMERALS IN DRAWING FIGURES

LIST OF REFERENCE NUMBERALS IN DRAWING FIGURES

Figure 2:
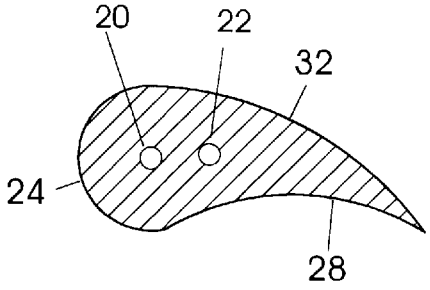
FIG. 2 is a sectional view of FIG. 1D, showing the elements which form the general shape of the device of FIGS. 1A–1D.
Figure 1C:
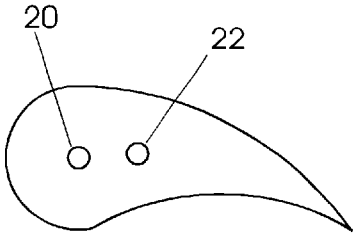
FIG. 1C is the front elevation view of the item in FIG. 1A.
Figure 6A:
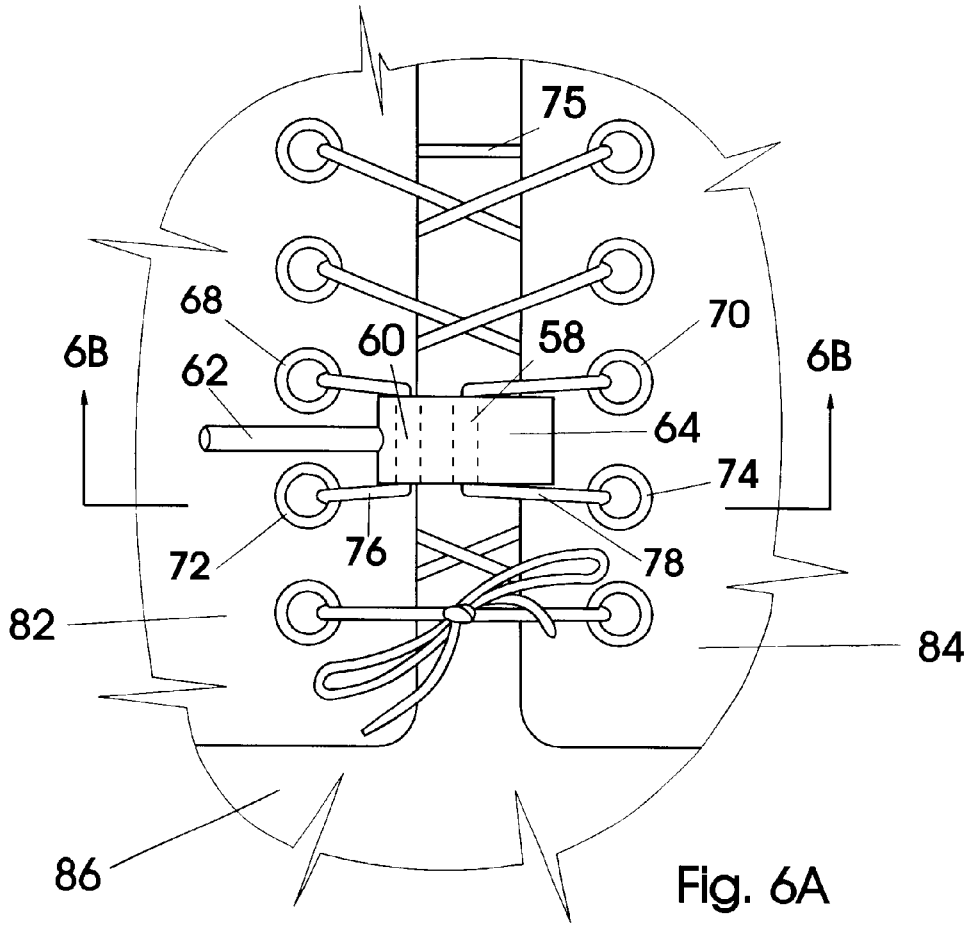
FIG. 6A shows a portion of a shoe with the device of FIGS. 5A–5D installed and in the open position, from the viewpoint of the wearer of the shoe.
Figure 6B:
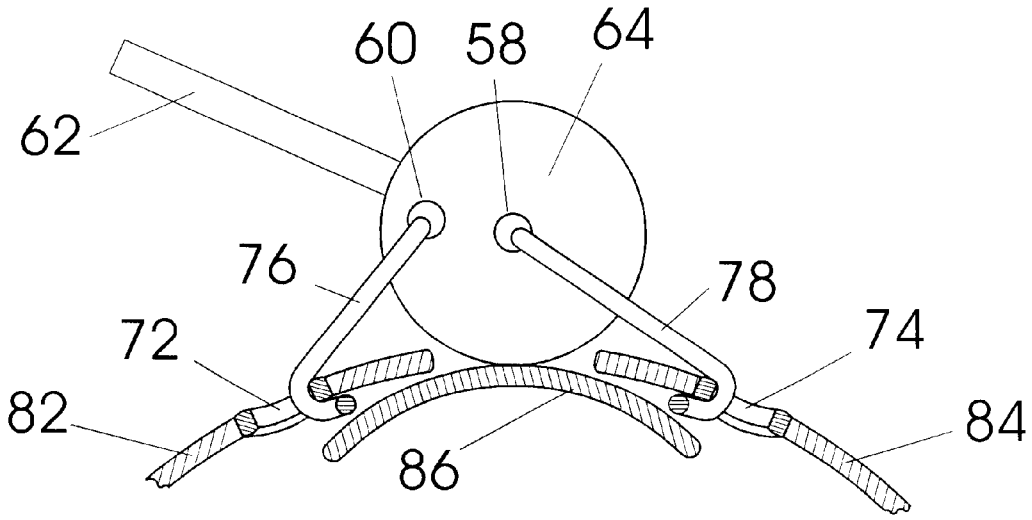
FIG. 6B shows an enlarged sectional view of the shoe in FIG. 6A with the device in the open position.
Figure 7A:
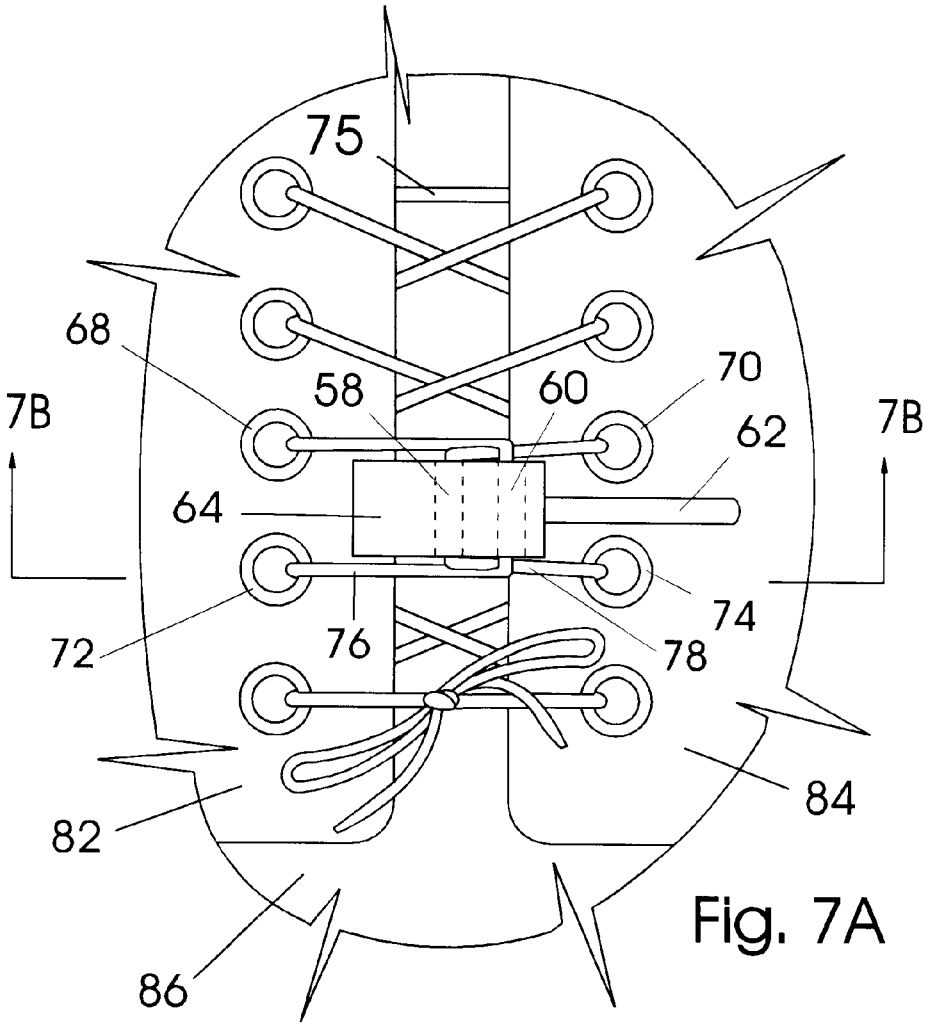
FIG. 7A shows a portion of a shoe with the device of FIGS. 5A–5D installed and in the closed and locked position, from the viewpoint of the wearer of the shoe.
Figure 7B:
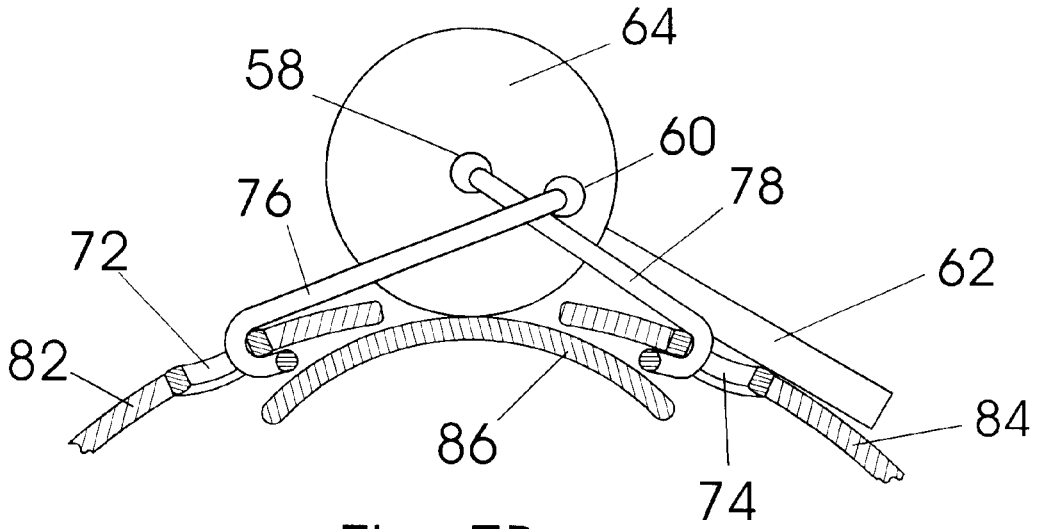
FIG. 7B shows an enlarged sectional view of the shoe in FIG. 7A with the device in the closed and locked position.

| Reference | Description | FIG. # |
|---|---|---|
| 2 | Sectional plane for section shown in FIG. 2 | 1D |
| 6B | Sectional plane for section shown in FIG. 6B | 6A |
| 7B | Sectional plane for section shown in FIG. 7B | 7A |
| 20 | Passage closest to concave arc 28 | 1A, 1C, 2, 9 |
| 22 | Passage closest to smaller convex arc 24 | 1A, 1C, 2, 9 |
| 24 | Smallest of two convex arcs | 2 |
| 28 | Concave arc | 2 |
| 32 | Largest of two convex arcs | 2 |
| 58 | Passage at center of cylindrical element 64 | 5A, 5B, 6B, 7B, 8 |
| 60 | Passage near surface of cylindrical element 64 | 5A, 5B, 6B, 7B, 8 |
| 62 | Handle element, perpendicular to axis of 64 | 5A–D, 6B, 7B, 8 |
| 64 | Cylindncal element of main embodiment | 5A–D, 6B, 7B, 8 |
| 68 | Eyelet, opposite 70, adjacent to 72 | 6A and 7A |
| 70 | Eyelet, opposite 68, adjacent to 74 | 6A and 7A |
| 72 | Eyelet, opposite 74, adjacent to 68 | 6A, 6B, 7A, 7B, 8 |
| 74 | Eyelet, opposite 72, adjacent to 70 | 6A, 6B, 7A, 7B |
| 75 | Shoe lace | 6A and 7A |
| 76 | Lace segment from eyelet 72 to passage 60 | 6A, 6B, 7A, 7B, 8 |
| 78 | Lace segment from eyelet 74 to passage 58 | 6A, 6B, 7A, 7B |
| 82 | Medial side of shoe upper | 6A, 6B; 7A, 7B, 8 |
| 84 | Lateral side of shoe upper | 6A, 6B, 7A, 7B, 8 |
| 86 | Tongue of shoe | 6A, 6B, 7A, 7B, 8 |

SUMMARY OF THE INVENTION

Detailed in this specification is a tensioning device for a laced closure, in particular the laced closure of an article of footwear. The tensioning device can be used with any existing lace-up shoe, and is designed to afford substantial mechanical advantage to the user in the effort to adjust the fit of athletic footwear for optimum performance.

Description—Main Embodiment

In keeping with the objects listed above, the device which is the main embodiment of the present invention takes the form of a circular cylindrical element 64 and a handle element 62 extending past the surface of element 64 in a perpendicular orientation as shown in FIGS. 5A–5D. The cylindrical element has through its length a passage 58 which has as its axis the central axis of the cylinder. Close to the outside surface of element 64 is a passage 60 which is parallel to passage 58 and offset from the axis of handle element 62 by a small angle.

The central axis of cylindrical element 64 becomes the axis of rotation when the device is used. In the device shown, the distance from this axis of rotation to the distal end of handle element 62 is approximately four times the distance between the axes of passages 58 and 60. A relationship essential to the function of the device is that the distance from the axis of rotation to the distal end of the handle element must be greater than the distance between the axis of rotation and the passage farthest from the axis of rotation.

Operation—Main Embodiment

FIG. 6A shows a portion of a typical athletic shoe as seen by the wearer when looking down at his or her right foot. Circular eyelets are shown as the guide elements in all the FIG. In FIG. 6A there are two rows of five eyelets each, one row on each side of the throat of the shoe upper. Four individual eyelets are numbered 68, 70, 72, and 74, as seen in FIG. 6A. A tongue 86 covers the user's foot, spanning the gap between and extending beneath medial side 82 and lateral side 84 of the shoe upper. Using a single elongated lace 75 the shoe is laced conventionally from the distal end of the throat up to and including eyelets 68 and 70. If conventional lacing order were continued, the lace end emerging from eyelet 68 would be threaded through eyelet 74 on the opposite side of the shoe; similarly, the lace segment emerging from eyelet 70 would go to eyelet 72.

To use the device, cylindrical element 64 is positioned at the throat of the shoe upon tongue 86 between paired eyelets 68 and 70 and paired eyelets 72 and 74, with its axis parallel to the rows of eyelets, and with handle element 62 extending between eyelets 68 and 72 on medial side 82 of the shoe, all as shown in FIG. 6A. In this drawing figure, passages 58 and 60 are shown as dashed hidden lines. The lace end emergent from eyelet 68 is threaded first through passage 60 and then through eyelet 72 on the same side of the shoe as eyelet 68. The lace end emergent from eyelet 70 is threaded first through passage 58 and then through eyelet 74. From eyelets 72 and 74, the ends of lace 75 are threaded conventionally to the proximal end of the two rows of eyelets and are tied together as seen in FIG. 6A. As the shoe is laced, the lace is pulled tight just as if there were no tensioning device present.

FIG. 6B, a sectional view through eyelets 72 and 74 of FIG. 6A, shows the position of the installed device before it is operated. Lace segment 76 is that portion of lace 75 which extends between eyelet 72 and passage 60. Lace segment 78 is that portion of lace 75 which extends between eyelet 74 and passage 58. It can be seen from FIGS. 6A and 6B that tension in the lace will tend to hold the device in the position shown, with handle element 62 toward side 82 and approximately centered between eyelets 68 and 72 as seen in FIG. 6A.

When the lace is subject to an elongating force less than its tensile strength, the lace can elongate only very slightly. Increasing the force applied to the lace results primarily in increased tension in the lace. Once its ends are tied together, the effective length of the now continuous lace 75 is fixed at the length of the loop of continuous lace bounded by the knot. Any substantial increase in the length of a segment of the loop requires the shortening of the lace in the balance of its complete path, accompanied by increased tension distributed throughout the loop.

The result of operating the device is shown in FIGS. 7A and 7B. FIG. 7A is identical to FIG. 6A except for the positions of the device and the lace segments directly influenced by this changed position. Handle element 62 has been rotated about the axis of cylindrical element 64 until prevented from further rotation by contact with lateral side 84 of the shoe. The rotation of handle element 62 causes passage 60 to rotate about the same axis to a new position, which changes the length and position of lace segment 76. Comparison of FIG. 6B with FIG. 7B reveals that the length of lace segment 76 in the final, closed position shown by FIG. 7B is greater than the length of segment 76 in the initial, open position shown by FIG. 6B. In the rotated position shown by FIG. 7B, the tension in lace segment 76 tends to further turn cylindrical element 64 in a clockwise direction. This tension holds handle element 62 against the shoe and prevents accidental release of the tension. The closed position is also maintained by the compression and friction at the points where the lace segments from medial side 82 cross over and touch the lace segments from lateral side 84, as shown in FIGS. 7A and 7B.

To simplify the discussion of forces acting in the system, FIGS. 6B and 7B show that lace segment 78 remains the same length and that the center of cylindrical element 64 remains in the same place. The slidable linkages, however, ensure that tension in one segment of the loop of lace is distributed throughout the length of the loop. Applying a force tending to elongate segment 76 would increase the tension throughout the lace because the lace is slidably attached to the tensioning device at passages 58 and 60 and also to sides 82 and 84 via the eyelets. Therefore, lengthening force applied to segment 76 would ultimately increase the tension in lace segment 78 and any lengthening of segment 76 would ultimately be shared with segment 78. Because the lace resists elongation, sides 82 and 84 will ultimately move closer together to relieve the strain which would result from lace elongation. FIG. 7B shows sides 82 and 84 in the same relative positions as in FIG. 6B, thus FIG. 7B shows only an instantaneous condition after the device has been moved but before the forces have been distributed to the balance of the loop of lace 75. Our discussion does not suffer from this simplification and we will continue to use it.

Since the length of lace segment 76 increases, the length of the balance of lace 75 through the rest of the shoe must decrease. The shortening of the lace through the rest of the shoe removes any slack in the lace resulting from the sequential grasping and releasing of the lace ends. The shortening of the lace remaining in the closure path will also pull lateral side 84 of the shoe toward medial side 82.

Figure 8A:
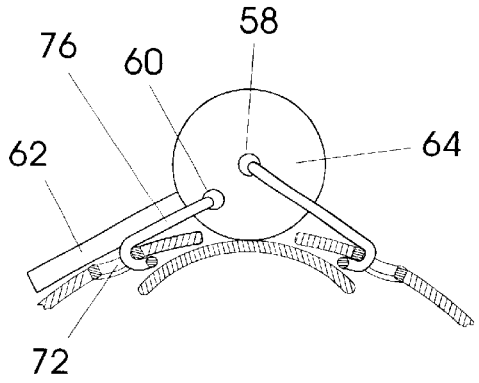
FIGS. 8A–8E are partial sectional views through the shoe of FIGS. 6A and 7A showing intermediary positions of the main embodiment of the present invention.
Figure 8B:
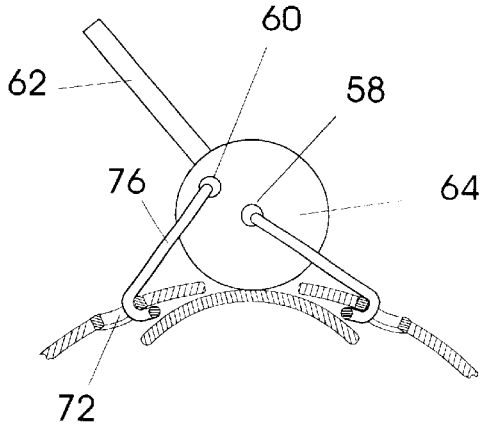
Figure 8C:
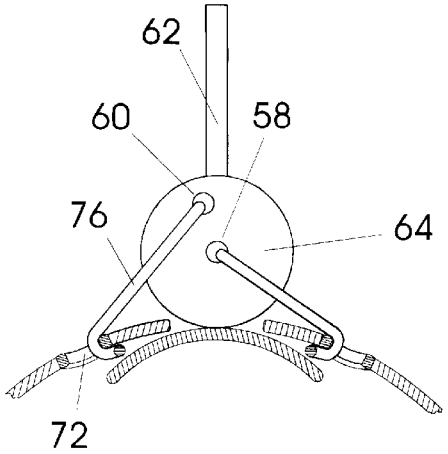
Figure 8D:
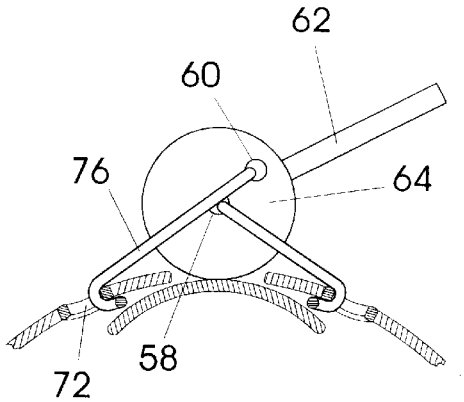
Figure 8E:
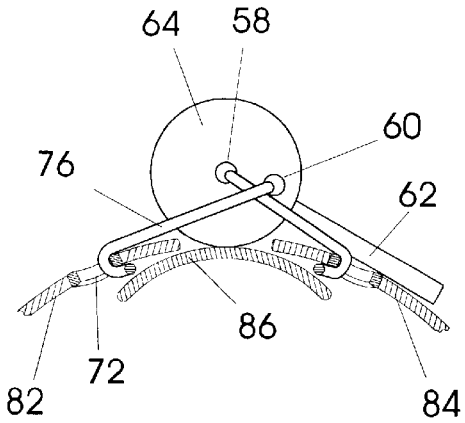
Figure 8F:
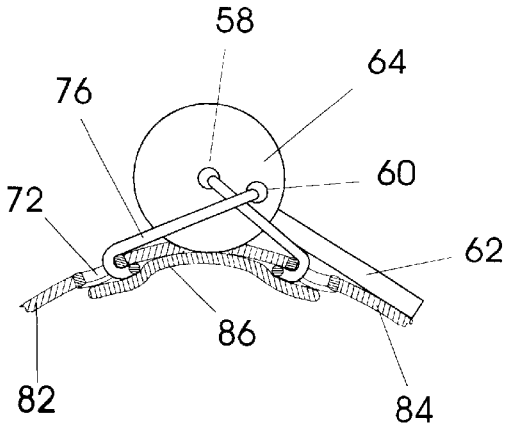
FIG. 8F is the shoe and device of FIG. 8E after the resultant force on the lace generated by the operation of the device has been distributed throughout the system.

FIGS. 8A–8E, sectional views through eyelets 72 and 74, show how the design attributes and use of the device apply forces which tend to stretch the lace as the device rotates from fully open to fully closed. FIG. 8E thus shows the shoe, device, and lace system at the instant of closure. The force initiated by the operation of the device is transmitted by the lace and tends to equalize throughout the length of the lace. The system elements least able to oppose the force will be made to move. FIG. 8F shows the shoe, device, and lace system after the forces have been fully distributed. In practice, the shoe upper will show the most change in position. Sides 82 and 84 will move closer together; compressible materials in tongue 86 and sides 82 and 84 will be deformed and further compressed, and spaces between such elements as the tongue, sides, foot, and lace will be minimized, such that the foot can no longer move with respect to the shoe. It is this tightening of the shoe and the very snug fit resulting, as shown in FIG. 8F, which is the object of the present invention and which is made possible by this design.

It can be seen by anyone skilled in the art that the drawings are illustrative only and actual shapes may vary widely for purposes of styling, size reduction, and minor fine tuning of the device. Since only a portion, about 75 percent, of the cylindrical surface is used as a bearing against the tongue of the shoe, the balance of that surface can be modified in any way. The shape and attachment of the handle element can be modified in an almost limitless manner. The exact positions of the passages and their cross sectional shape may also be modified somewhat without changing the operation and intent of the invention.

Operation—Main Embodiment—Mechanical Advantage

The design of the present invention permits the user to gain mechanical advantage by virtue of a lever system. All lever systems can be described by an effort arm, a load arm, and a fulcrum.

A fulcrum generally is the point of rest upon which a lever turns in moving a body. In the device shown by FIGS. 5A–5D, handle element 62 acts as a lever; the lever turns around that point on the axis of rotation which intersects the axis of handle element 62. Considered in a two dimensional profile as in FIGS. 6B, 7B, and 8A–8F, the fulcrum is located at the center of passage 58.

In general, the effort arm is the rigid substance between the fulcrum and the point of effort. In the present invention, the effort arm is the rigid portion of the device which connects the axis of rotation to the point where the effort of operating the device is exerted. The point of effort is at the distal end of handle element 62. The direction of the effort force always remains perpendicular to the line between the point of effort and the fulcrum, because the user changes the direction of the force applied in such a way that rotation continues and user effort is minimized. The length of the effort arm does not vary; it is the perpendicular distance between the point of effort and the axis of rotation.

A load arm generally is the rigid substance between the fulcrum and the point connected to the load. In the device of FIGS. 5A–5D, the load arm is the portion of cylindrical element 64 between the fulcrum, at the center of passage 58, and passage 60, where the load connects to the device via the lace. The length of the load arm is the perpendicular distance between the fulcrum and the line of force of the load. The line of force of the load is along the axis of lace segment 76, and the direction of the force of the load is toward eyelet 72.

FIGS. 8A–8E are sectional views through eyelets 72 and 74 which illustrate the way in which the geometry of the device influences the forces operating in the system at positions intermediate between fully open and fully closed. FIG. 8A depicts the fully open position and FIG. 8E depicts the fully closed position. FIGS. 8B, 8C, and 8D are sequential intermediate positions. The terminology "over-center position" as used in this specification should be understood to indicate that angular position of a lever in which the line of action of the resultant of the forces acting on the lever passes through the fulcrum of the lever. The over-center position is shown by FIG. 8D.

From FIGS. 8A–8E, it can be seen that the length of the load arm varies. It reaches its maximum at the position shown in FIG. 8B, when the line between passage 58 and passage 60 is perpendicular to lace segment 76. The length of the load arm reaches a minimum of zero at the over-center position shown in FIG. 8D.

The intensity of the load force also varies with position. The load force varies as a function of the length of lace segment 76. It is clear that the length of segment 76 varies continuously as passage 60 follows a circular arc from its initial to its final position. The length of segment 76 increases continuously from the initial position shown by FIG. 8A to the over-center position seen in FIG. 8D; it then decreases slightly to arrive at its final length as shown by FIG. 8E.

Mechanical advantage is defined as the ratio of the force overcome to the force applied. In a system employing a lever, at any position the ratio of the load force overcome to the effort force applied is equal to the length ratio of the effort arm to the load arm. In a lever system where both the load arm and the effort arm are of constant length, the mechanical advantage is constant.

The mechanical advantage provided by the use of this device is variable. The shoe lace is initially pulled tight and tied securely. Even in the initial open position of the device there is tension on the lace and thus load on the device. As effort is applied and rotation is effected, the load on the device, which is a function of the tension in the lace, increases. To continue the rotation in the direction of closure, the effort must likewise increase until just before reaching the position shown in FIG. 8D; there remains, however, mechanical advantage at every position due to the design of the device. The load force increases until the over-center position is achieved. Prior to reaching this position, rotation is opposed by the tension in the lace. After passing through this position, continued rotation of the device is facilitated by the tension in the lace, which decreases the effort force required to continue rotation in the direction of closure, and which eventually causes the device to snap into the final closed and locked position.

The minimum mechanical advantage is the distance from the point of effort to the fulcrum divided by the distance between passage 58 and passage 60. Mechanical advantage favorable to the user is present only when this ratio is greater than one. Since the length of the load arm varies, the mechanical advantage at any point also varies, from a minimum of about 4 to an instantaneous maximum at the over-center position. Total mechanical advantage can be obtained explicitly by integrating over the actual path the differential equation representing the variable ratio of effort arm to load arm; it is approximately 7 for the device of FIGS. 5A–5D.

In any shoe and lace system, each incremental unit tensioning of the lace makes more difficult any subsequent tensioning. The greater the tension in the lace, the greater the load to be overcome, and the more firmly the lace segments between the tongue and the shoe upper are squeezed, which increases the friction in the system and opposes further tightening. It is thus a great asset for the user who requires a very tight fit to gain mechanical advantage in overcoming this inescapable system property.

Description and Operation—Alternative Embodiment

Figure 1A:
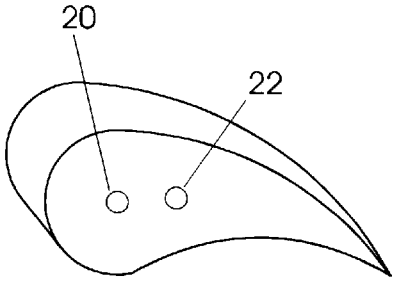
FIG. 1A shows a perspective view of the alternative embodiment of the device.
Figure 1D:
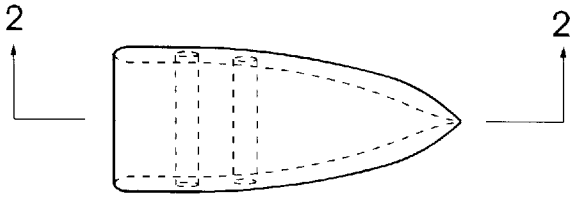
FIG. 1D is the plan view of the item in FIG. 1A.
Figure 1B:
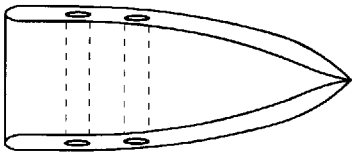
FIG. 1B is the bottom view of the item in FIG. 1A.

An alternative embodiment of the present invention, shown in FIGS. 1A–1D, takes the form of a one-piece rigid body. FIG. 2, a sectional view of FIG. 1D, shows that three arcs define the outline of the rigid body in cross section. An arc 24, including approximately 190 degrees of convex curvature, defines one end of the rigid body. An arc 28 connects at one end with one end of arc 24 and describes approximately 63 degrees of concave curvature. For reasons which will become apparent, arc 28 has the approximate curvature of the instep of a skate or athletic shoe. An arc 32 joins the opposite end of arc 24 to the opposite end of arc 28. Arc 32 encloses approximately 54 degrees of convex curvature.

Through the rigid body are a passage 20 and a passage 22, positioned as shown in FIGS. 1A–1D and FIG. 2. The passages are of sufficient diameter to allow a lace to be threaded through. The axis of passage 20 is at the center of arc 24 and passage 22 is parallel to passage 20 and offset slightly from the line between the center of passage 20 and the point where arc 28 joins arc 32.

Figure 9:
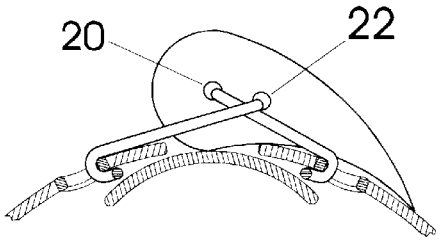
FIG. 9 is the shoe of FIG. 7B with the alternative embodiment device of FIG. 1C in the closed and locked position replacing the main embodiment.

FIG. 9 shows the device of FIG. 1A–1D substituted for the main embodiment device in an elevation view and installed in the closed position on the shoe from FIG. 7B. It is readily seen that the concave arc approximately parallels the convex exterior curvature of the shoe. The larger convex arc provides a low and smooth profile for the device and shoe system when in the closed and locked position, such that the device is not susceptible to accidental disengagement by catching on items in the surroundings of the wearer.

At all intermediate positions between open and closed, the alternative embodiment device provides mechanical advantage to the user as has been described in detail in the section pertaining to the main embodiment, above.

Conclusion, Ramifications, and Scope

It is evident that the device embodying the present invention can be used to great advantage by the athlete who requires maximum performance from laced athletic footwear. By virtue of the design geometry and the resulting mechanical advantage, any user can generate much greater tension in the laces of laced footwear than would be possible without the use of the device. Furthermore, this increased tension is directed by the device such that it must act to pull together the sides of the shoe upper, making efficient use of the increased tension and resulting in a tighter fit than the user could otherwise enjoy. This tensioning device has several additional advantages in that it

- can be used with or added to any existing lace-up shoe, boot, or other laced closure,
- allows the user to secure the shoe tighter than would be possible without a device,
- can be loosened without untying and swiftly retightened,
- locks in place after tensioning and cannot be easily or accidentally unlocked,
- is lightweight, very small, simple and inexpensive to manufacture,
- is easy to use,
- provides to the user mechanical advantage in applying the tensioning force, making possible a very snug fit,
- provides non-bearing surfaces upon which to place custom logos or decorative designs, and
- can be made in one piece, providing durability and ease of manufacturing.

Although the description above contains many specificities, these should not be construed as limiting the scope of the invention but merely as providing illustrations of some of the presently preferred embodiments of this invention. For example, the shape of the non-bearing surfaces can be modified considerably, and the passages could be oval rather than circular in cross-section without affecting the principles by virtue of which this invention functions. For another example, it is not necessary that the effort arm coincide in space with the line most directly connecting the fulcrum to the point of effort, although in each embodiments above, the effort arm does coincide with that line. The guide elements which interact with the lace could exhibit considerable variety, including but not limited to hooks, simple holes, and frictionless eyelets. The device can be made either integrally or in separate pieces, from a variety of materials and in any color. Its overall size can vary to suit the dimensions of the closure with which it is to be used.

Thus the scope of the invention should be determined by the appended claims and their legal equivalents, rather than by the examples given.

We claim:

1. A tensioning device for the lace at the throat of a laced shoe, comprising:

a substantially cylindrical element, said cylindrical element having through it two passages approximately parallel to the axis of said cylindrical element, said passages offset one from the other by a predetermined distance, said cylindrical element having a rigid projection therefrom, said projection being oriented substantially perpendicular to the axis of said cylindrical element and along with said cylindrical element being rotatable about the axis of said cylindrical element from an open position into a closed position and vice versa, wherein a first of said passages can slidably enclose a first segment of said lace and a second of said passages can slidably enclose a second segment of said lace, wherein said tensioning device cooperates with said lace, said first segment having each of its two ends slidably connected to a first side of said throat, said second segment having each of its two ends slidably connected to a second side of said throat, whereby the moving of said projection from said open position to said closed position causes the first of said passages with its enclosed said first segment to move away from said first side and toward said second side and the second of said passages with its enclosed said second segment to move away from said second side and toward said first side, thereby increasing the tension in said lace, thereby urging each of said first side and said second side to move closer to the other, thereby causing said shoe to fit an enclosed foot more tightly than would be otherwise achievable without a tensioning device.

2. In an article of footwear including a pliant upper formed to substantially surround the foot of a wearer and a sole attached to said upper, said upper including an opening defined by a first edge and an opposing second edge substantially parallel to said first edge and a plurality of eyelet means disposed on either side of said opening proximate said first edge and said second edge, said first edge and said second edge held together by an elongated shoe lace, said shoe lace extending between said first edge and said second edge and through said eyelet means on opposite sides of said opening, the improvement comprising:

a tensioning device, said tensioning device comprising:

a substantially cylindrical element, said cylindrical element having through it two passages approximately parallel to the axis of said cylindrical element, said passages offset one from the other by a predetermined distance, said cylindrical element having a rigid projection therefrom, said projection being oriented substantially perpendicular to the axis of said cylindrical element and along with said cylindrical element being rotatable around the axis of said cylindrical element from an open position into a closed position and vice versa, wherein the axis of said cylindrical element is oriented substantially parallel to and between said first edge and said second edge, wherein a first of said passages slidably encloses a first segment of said lace, said first segment having each of its two ends slidably connected to said first edge and a second of said passages slidably encloses a second segment of said lace, said second segment having each of its two ends slidably connected to said second edge, wherein the moving of said projection from said open position to said closed position causes the first of said passages with its enclosed said first segment to move away from said first edge and toward said second edge and the second of said passages with its enclosed said second segment to move away from said second edge and toward said first edge, thereby increasing the tension in said shoe lace, thereby urging each of said first edge and said second edge to move closer to its opposing edge, thereby increasing the tension of said pliant upper around said foot to a value not achievable in the same said article of footwear without a tensioning device.

3. A lace tensioning system adapted to tighten a pliant enclosure around a body, said enclosure having two approximately parallel rows of guide elements for slidably attaching a lace, said parallel rows separated by a variable distance, said parallel rows being held together by an elongated lace of predetermined length, said lace having its ends tied together to form a continuous lace, said continuous lace cooperating with a tensioning device, said tensioning device comprising:

a substantially cylindrical element, said cylindrical element having through it two passages approximately parallel to the axis of said cylindrical element, said passages offset one from the other by a predetermined distance, said cylindrical element having a rigid projection therefrom, said projection being oriented substantially perpendicular to the axis of said cylindrical element and along with said cylindrical element being rotatable around the axis of said cylindrical element from an open position into a closed position and vice versa, wherein said cylindrical element is oriented with its axis substantially parallel to and between said parallel rows, wherein a first of said passages slidably encloses a first segment of said continuous lace, said first segment having each of its two ends slidably connected to a first of said parallel rows and a second of said passages slidably encloses a second segment of said continuous lace, said second segment having each of its two ends slidably connected to a second of said parallel rows wherein the moving of said projection from said open position to said closed position causes the first of said passages with its enclosed said first segment to move away from said first of said parallel rows and toward said second of said parallel rows and the second of said passages with its enclosed said second segment to move away from said second of said parallel rows and toward said first of said parallel rows, thereby increasing the tension in said continuous lace, thereby urging each of said parallel rows to move closer to the other, thereby increasing the tension of said pliant enclosure around said body to a value not achievable in the same said lace tensioning system without a tensioning device.

4. The lace tensioning system of claim 3, wherein said body is a human foot.

5. The lace tensioning system of claim 3, wherein said enclosure is the combined upper and sole of an athletic shoe.

6. The lace tensioning system of claim 3, wherein said guide elements are eyelets.

7. The lace tensioning system of claim 3, wherein said lace is a shoe lace.

* * * * *